United States Patent [19]

Haker

[11] 4,412,631

[45] Nov. 1, 1983

[54] CAROUSEL CARD DISPENSER

[76] Inventor: Floyd H. Haker, 6546 Linden La., Dallas, Tex. 75230

[21] Appl. No.: 303,293

[22] Filed: Sep. 17, 1981

[51] Int. Cl.[3] ..... A47F 1/10

[52] U.S. Cl. ..... 221/66; 40/381; 40/464; 40/509; 221/113; 271/9

[58] Field of Search ..... 221/66, 113, 132, 121, 221/122, 129, 274, 275, 112, 119, 311; 271/9, 3.1; 206/455; 40/373, 374, 378, 381, 464, 509, 511

[56] References Cited

U.S. PATENT DOCUMENTS 3,445,035 5/1969 Ackerman ..... 221/129

3,809,287 5/1974 Muller-Scherak ..... 221/66

*Primary Examiner*—F. J. Bartuska

*Attorney, Agent, or Firm*—Warren H. Kintzinger

[57] ABSTRACT

A dispenser for the controlled one at a time dispensing of a magnetic card to an operator who inserts the card into a magnetic card reader for entry of an active number in an "Electronic Point of Sale" advertising medium reaching a predetermined captive audience while engaged in the spending of money, such as in supermarkets, shopping centers, hotels, trade shows, airports, drug stores and the like. The card is also used to imprint the card number embossed thereon on coupons in a coupon book then handed to the shopper with the card then returned to the dispenser to enable the sequential dispersing of another card. A card being reinserted into the card dispensing carousel is inserted into a card return slot to rest at one end on a retainer upper ledge until an operator depresses an actuator button forcing the end edge of the returned card past the upper edge of the retainer down onto a lower ledge of the retainer activating a carousel upper drive switch in the process. This switch activation turns on a motor that turns the carousel through a gear drive train. With limited initial rotational movement of the carousel the replaced card moves off the retainer and drops into its card storage compartment and the upper drive switch is released. While this is occurring a lower switch is rotation cam actuated to continue carousel rotation movement positioning to the next card storage compartment. As the carousel is rotated to this successive card dispensing position a card is extended from the bottom of the respective card storage compartment by a stationary cam as the carousel rotates to position. This results in another card being partially extended for removal by the operator and use in a repetitive use operational cycle. The carousel is provided with a clear transparent cover to enhance the appearance and interest thereof to audience participants in the advertising medium environment for the system used with the carousel mounted on an advertising system control desk.

16 Claims, 8 Drawing Figures

CAROUSEL CARD DISPENSER

Figure 1:
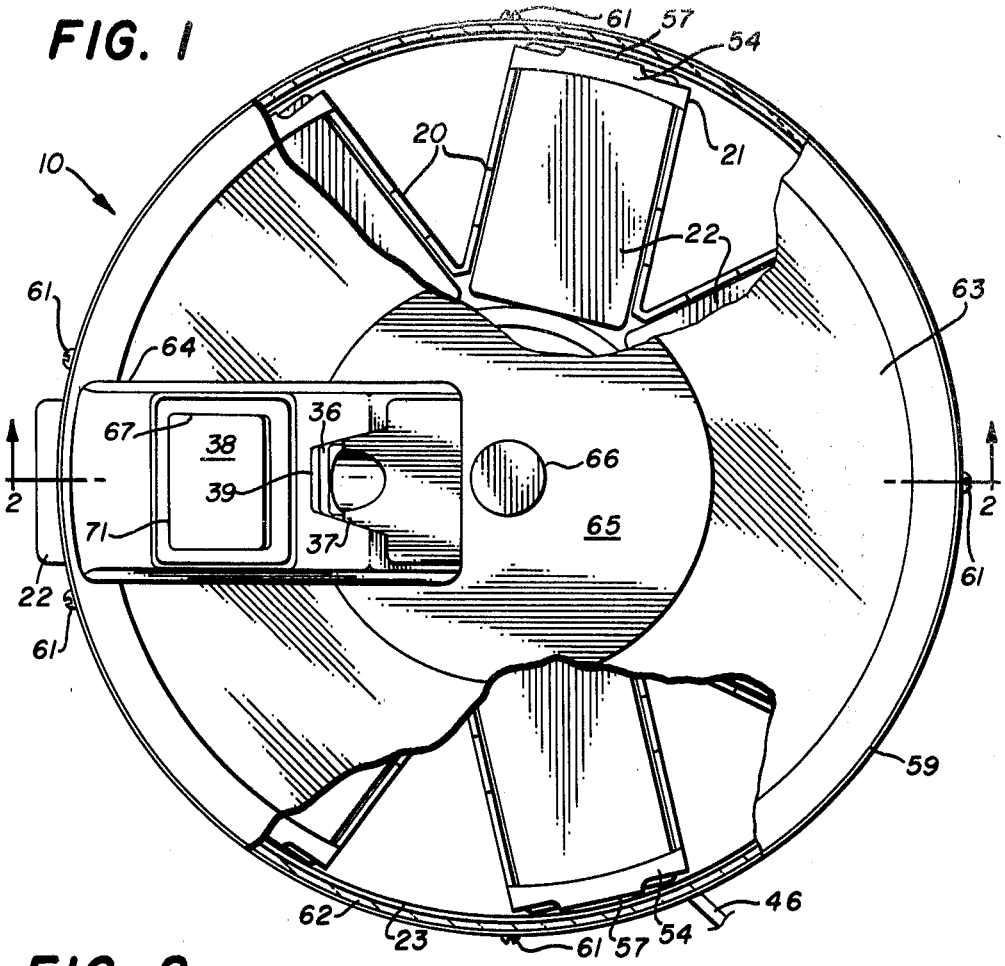

This invention relates in general to card storage and dispensing units for dispensing magnetic strips encoded and/or embossed cards that may be computer input read and used for imprinting coupons and, in particular, a carousel card dispenser that stores numerous cards in each storage compartment of a multicompartment carousel.

Magnetic strip encoded and/or embossed cards are dispensed for use in a computer based distributed point-of-sale advertising system that does achieve point-of-sale advertising with color TV type monitors presenting advertising to consumers at the place where purchasing decisions are made. Coupon control is provided with "Cents Off" coupon booklets distributed by a computer console attendant who imprints each coupon booklet with a number, from a one at a time dispensed card, that is entered into a remote computer of the system by the operator at that location and subsequently transmitted to a central computer. By this system it is possible for each advertizer utilizing the system to know the number of his coupons distributed, when and where they were issued, and the redemption rate with such coupon control having significant cost advantages to the advertiser through elimination of fradulent coupon redemption. Coupon and coupon imprinting control with card dispensing control assumes even more importance with the excitement of sweepstakes includes in the system. This occurs with, from a pool of coupon numbers, winners being selected to receive prizes, either free groceries or cash, on a regular basis. With winning numbers being chosen from a list of recently inputed coupon numbers the probability of a winner at any one location is quite high, approximately one in one hundred every twelve minutes. Obviously, this would be very effective in maintaining consumer interest in the videotaped advertising being displayed since winning numbers are superimposed on the commercial being played on the store located video system.

A customer entering a store goes to a microcomputer console station and requests participation in sweepstakes and couponing. The console attendant takes a carousel dispensed card and inserts it into a mag-card reader with the card number going into the memory of a microcomputer at the station to be later transferred on to a central processing unit, and recorded and also printed out. The card is also placed in an imprinter to imprint the number on a coupon booklet along with store location and date with the coupon booklet then given the customer, and then the card promptly returned and inserted back into the carousel card dispenser.

It is, therefore, a principal object of this invention to provide a secure one-at-time mag-card dispenser for use in a point-of-sale advertising system.

Another object is to provide a card dispenser that does not dispense another card until the previous dispensed card has been returned to the dispenser.

A further object is to be able to dispense cards in any numerical sequence required.

Still another object is to provide a multicompartment card storage and dispensing unit in carousel form step rotational from one card compartment to the next sequentially for successive dispensing of cards.

A further object is for the cover of such a card dispensing carousel unit to be transparent in order that the card storage and dispense feed may be seen by participating customers in the store.

Features of the invention useful in accomplishing the above objects include, in a carousel mag-card dispenser for use in an "Electronic Point of Sale" advertising medium, a cam positioned partially extended dispensed card that is removed from the dispenser, mag read and coupon print processed and returned to the carousel dispenser. The card is inserted in the rotational carousel dispenser card return slot to rest at one end on a retainer upper ledge. The operator then depresses an actuator button forcing the end edge of the returned card past the upper ledge of the retainer down onto a lower ledge of the retainer, simultaneously activating a carousel upper drive switch in the process that is subject to such activation only by action of the actuator button through a reinserted card in such placing. The carousel drive motor is turned on by such switch activation to turn the carousel with drive through a gear train. With limited initial rotational movement of the carousel the replaced card end moves off the retainer and drops down into its card storage compartment and the upper switch is released. While this is occurring a lower switch is rotation cam actuated by a cam element for the next card compartment, to continue carousel rotation movement positioning to the next card storage compartment station with the lower switch released from cam element actuation. As the carousel is rotated to this successive card dispensing position a card is extended from the bottom of the respective card storage compartment by a stationary cam as the carousel rotates to station position. A clear transparent carousel cover enhances appearance and provides a show of interest to the participating customer in the advertising medium environment for the system used with the carousel mounted on an advertising system control desk.

A specific embodiment representing what is presently regarded as the best mode of carrying out the invention is illustrated in the accompanying drawings.

Figure 2:
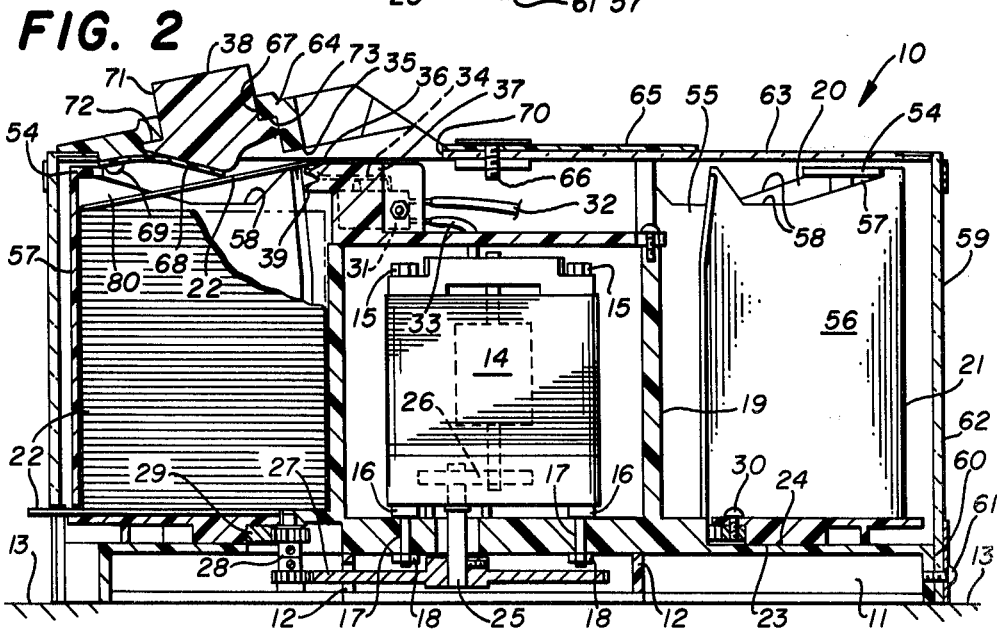
Figure 3:
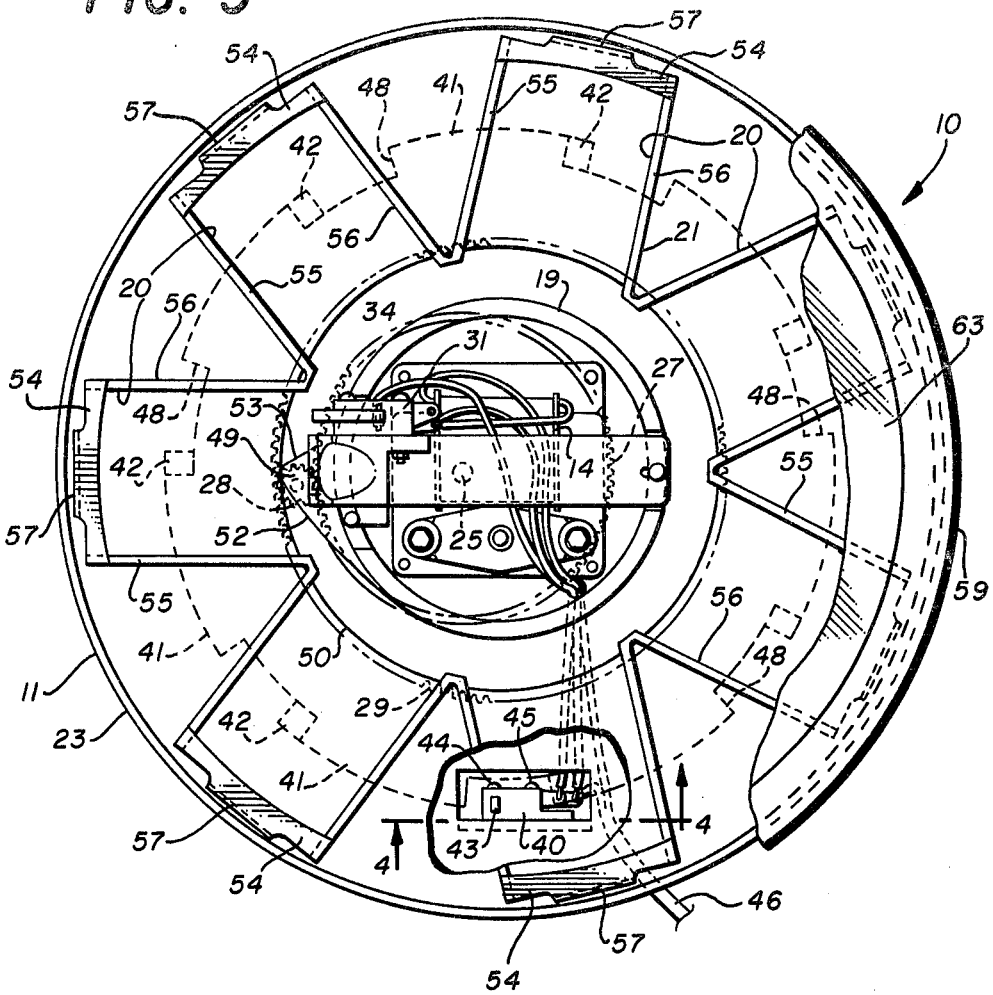
Figure 4:
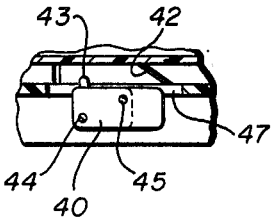
Figure 5:
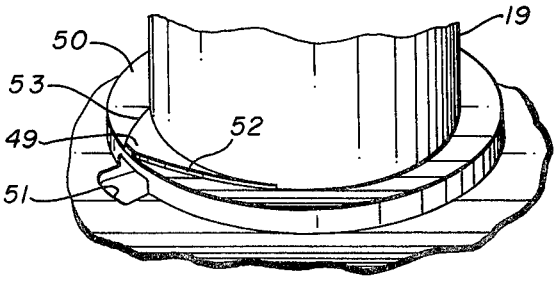
Figure 6C:
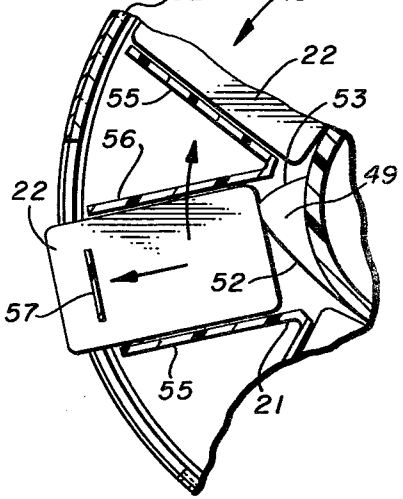
Figure 6B:
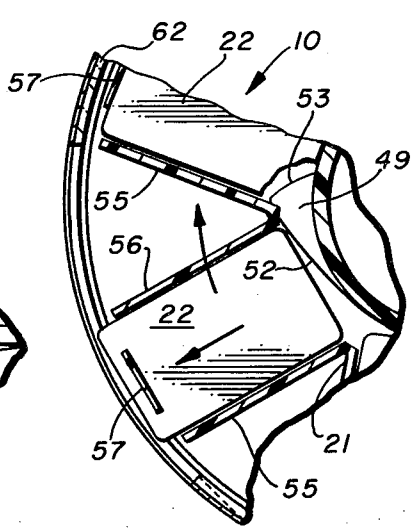
Figure 6A:
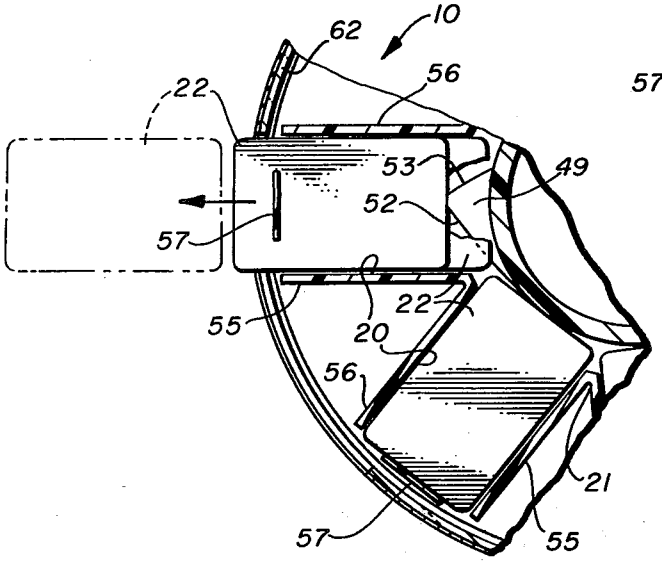

In the drawings:

FIG. 1 represents a top partially cutaway top plan view of a carousel mag-card dispenser;

FIG. 2, a side elevation view taken from line 2—2 of FIG. 1 of the carousel card dispenser;

FIG. 3, a top cutaway plan view showing card compartment, switch, cam and drive train in the carousel card dispenser;

FIG. 4, a partial side elevation view of a bottom switch in the carousel card dispenser;

FIG. 5, a partial perspective of cam card extending detail within the carousel card dispenser; and, FIGS. 6A, 6B and 6C are, respectively, progressed positions in rotation of the carousel with an extended card from the bottom of a card storage container on dispensing station in FIG. 6A, moving in clockwise rotation progressively in 6B and 6C with a bottom card of the next card container being cammed outwardly with continued rotation until the card being cammed outward is in the extended position of 6A as the next card container comes to station as in 6A.

Referring to the drawings:

The carousel card dispenser 10 of FIGS. 1 and 2 includes a circular disk base 11 open toward the bottom with reinforcing ribs 12. The base 11 may be mounted to a desk top 13 as by wood screws (not shown) or by a suitable adhesive in a conventional manner. Base 11 mounts electric motor 14 with bolt assemblies 15 extended through the motor 14 mount spacers 16 and base openings 17 to nuts 18. A center cylindrical motor housing 19 projects upward to not only form a housing for motor 14 but a fixed center post about which multicontainer 20 carousel 21 rotates. The carousel 21 of card dispenser 10 is provided with seven equally spaced radially extended card 22 storage containers 20 and is supported for sliding rotative movement of the carousel base 23 over annular surface 24 of dispenser base 11 as the carousel 21 is driven in clockwise rotation, as viewed from above, through successive card 22 dispensing station positions.

Referring also to FIG. 3, a drive shaft 25 extends from motor gear train 26 to gear 27 that drives gear and shaft assembly 28 to in turn drive ring gear 29 that is mounted in carousel base 23 as by screws 30. An upper or first stage switch 31 connects power from wire 32 to wire 33 to start motor 14 whenever switch 31 is closed by flexible switch lever 34 being depressed by a card 22 after being reinserted in carousel card return slot 35. An end of a reinserted card 22 rests on the upper ledge 36 of retainer 37 until the operator depresses actuator button 38 to resiliently deflect the plastic card 22 downward forcing the end edge of the returned card past the upper ledge 36 of the retainer down onto lower ledge 39 simultaneously depressing flexible switch lever 34, thereby activating carousel upper first stage drive switch 31. Closing of switch 31 starts the carousel drive motor 14 to turn the carousel 21 through limited initial rotational movement with the replaced card 22 end moving off the retainer lower ledge 39 releasing the upper switch 31 and the replaced card 22 completes its drop down into its card 22 storage compartment 20. Before the upper switch 31 is released cam activated lower switch 40 is actuated to supply drive power to motor 14 and continue carousel rotation movement positioning to the next card storage compartment station with drive stop upon lower switch 40 release from cam element actuation.

The carousel 21 has seven card 22 storage compartments 20, each of which stores many cards 22, and seven cam sections 41 on the carousel base 23 that rotate with rotation of the carousel as driven by motor 14. Referring additionally to FIG. 4, each cam section 41 has a sloped leading cam ramp 42 for engaging and depressing the actuation button 43 of second stage switch 40 that is mounted in fixed position in base 11 as by screws 44 and 45. An electrical power line 46 extends into the carousel base 11 for connection through switches 31 and 44 to motor 14 to provide the controlled drive of motor 14 and carousel 21 required. The under surface 47 of each cam section 41 extends the required distance to a rear edge 48 with fall off of switch button 43 and deactivation of second stage switch 44 to shut power off to motor 14 to thereby stop rotation of carousel 21 with a card 22 storage compartment 20 properly on station dispensing a card 22 from the bottom of the stack of cards 22 of that card storage compartment 20.

The card dispensing cam 49 that extends from the outer surface of cylindrical motor housing 19 is shown to be a fixed-in-place cam immediately above annular base shoulder 50. In the base is a clearance opening 51 for carousel drive mechanism wherein gear assembly 28 extends for engagement with ring gear 29 that is assembled to and rotates with the carousel 21. The cam 49 forward drive ramp surface 52 is such as to properly drive the bottom card 22 that is being dispensed from a card storage compartment 20 through progressed positions of a card 22 with carousel clockwise rotation progressed from entrance onto the ramp 52 in FIG. 6A progressively into the states of FIGS. 6B and 6C to the on station dispensing state of the extended card 22, again in FIG. 6A. The card 22 being dispensed may be manually withdrawn by the operator to a free state as indicated in phantom in FIG. 6A. The back of cam 49 has a fast fall off slope edge 53 in order that the cards 22 in the card storage compartment 20, last dispensing a card 22 that has been returned to that compartment, may fall the thickness of one card 22 as the cards 22 of that compartment are rotated beyond alignment with cam 49. Cards 22 other than the card 22 being dispensed of the card dispensing compartment 20 ride over the upper surface of cam 49 that is approximately the thickness of only one card 22 in order that only one card 22, a compartment 20 bottom card, is dispensed at a time. Each card storage and dispensing compartment 20 dispenses one card 22 per complete revolution of the carousel 21. A dispensed card 22 must be returned to its compartment 20 before the carousel 21 is drive actuated to rotationally bring the next compartment 20 to the card 22 dispensing station. A plastic bridge 54 is provided spanning compartment side walls 55 and 56 at the upper outer end of each card compartment 20, and a resiliently deflectable card depending retainer 57 extends down from each bridge 54 to at least one card 22 spacing from the upper surface of carousel base 23. Card compartment 20 side walls 55 and 56 are each provided with a clearance notch 58 to insure clearance for slot structure and the rotationally fixed actuator button 38 during rotation of carousel 21 regardless of the depressed actuated state of button 38.

A carousel cover 59, shaped very much like a cake cover, is fastened to the circular disk base 11 around the peripheral cylindrical surface 60 thereof by screws 61 except for a card 22 dispensing opening therein. The cylindrical wall 62 and much of the top 63 of cover 59 are a clear transparent plastic to enhance appearance and provide a show of interest to the participating customer in the advertising medium environment. The actuator button 38 and the carousel card return slot 35 are part of a structure 64 including a mounting disk 65 fastened at the center to cover top 63 by screw assembly 66. The structure 64 is of molded plastic with slot 35 therein and a guide opening 67 for actuator button 38, mounts a resiliently deflectable return spring 68 by screw 69 and is retained in a receiving opening 70 in cover top 63. The actuator button 38 has a rectangular shank 71 slidably retained in button guide opening 67 and a bottom shoulder 72 seating an opening ledge 73 when returned to the actuator button 38 non-actuated, non-depressed state. It is of further interest to note that first stage switch 31 is mounted to the clockwise rotational side of retainer 37.

Thus there is provided a carousel card dispenser for the controlled one at a time dispensing of magnetic cards to an operator who inserts the card into a magnetic card reader for entry of an active number in an "Electronic Point of Sale" advertising medium with an immediate CRT readout to the on-location operator that the card number has been properly read and entered in the computer based system. The carousel card dispenser is very useful as an important part of an advertising system, having many positive advantages minimizing problems of coupon rip-off in eliminating fraud, misredemption, counterfeiting and the problem of mass clippings from unsold magazines and newspapers. The dispenser is used in an advertising system putting coupons in the hands of active and new buyers not primarily brand conscious customers, providing a count of number of coupons distributed each day, facilitates recording of the location of distribution and the time of distribution with distribution computer readout available. The system also increases sales via coupon advertising use as intended and forces purchases on data of coupon date of issuance.

Whereas this invention is here illustrated with respect to a certain embodiment thereof, it should be realized that various changes may be made without departing from the essential contributions to the art made by the teachings hereof.

I claim:

1. In a dispenser for the controlled one at a time dispensing of cards from a quantity of cards stored in the dispenser, to which a card must be returned to activate the dispensing of the next successive card to be dispensed: card storage means; card dispense extending means for extending one card at a time from said card storage means for removal by an operator and use in a repetative use operational cycle; card to storage insertion means; and dispenser actuating means positioned for activation with a card reinserted in said card to storage insertion means; wherein said card storage means includes a card storage compartment; and said card dispense extending means includes a card extend drive cam, and drive means for driving said storage compartment and said card extend drive cam in relative movement for cam drive dispense extending a card from said card storage compartment; and wherein said drive means includes electric motor means; and said dispenser actuation means includes a drive means activating switch subject to activation to the on state by each card reinserted in said card to storage insertion means as the card is being moved to a card storage compartment.

2. The card dispenser of claim 1, wherein said dispenser is a carousel dispenser with a plarality of said card storage compartments in a rotational carousel; fixed base means mounting said rotational carousel for relative rotation thereon; and wherein said card extend drive cam is non-rotationally fixed to said fixed base means.

3. The carousel card dispenser of claim 2, wherein a cover, as part of said carousel dispenser, has a generally circular top and a depending cylindrical skirt portion mounted on said base, encloses said rational carousel.

4. The carousel card dispenser of claim 3, wherein most of said cover is transparent.

5. The carousel card dispenser of claim 3, wherein said drive means include a lower rotation cam actuated switch that when actuated maintains electric drive power to said drive motor for a time after said drive means activating switch is released.

6. The carousel card dispenser of claim 5, wherein said lower rotation cam actuated switch is fixed position mounted on said base and wherein there is a plurality of duplicate cam sections equal in number to the plurality of said card storage compartments, each of such structural length to maintain electric drive power to said drive motor for a predetermined time and specific amounts of rotation by steps in bringing said card storage compartments successively to card dispensing station position.

7. The carousel card dispenser of claim 6, wherein said card extend drive cam non-rotationally fixed to said fixed base means is positioned and has a card engaging drive ramp such as to position the bottom card of a vertical stack of cards in a card storage compartment to the card extended state as that respective card storage compartment is brought to and stopped at the card dispense extended station.

8. The carousel card dispenser of claim 7, wherein said card extend drive cam non-rotationally fixed to said fixed base means is approximately the thickness of a single card of the cards stored in each of said card storage compartments of the carousel.

9. The carousel card dispenser of claim 8, wherein said drive motor is contained in a centrally located round motor housing chamber about which the carousel rotates; and a drive train interconnecting said drive motor and said carousel with a ring gear attached to said carousel part of said drive train.

10. The carousel card dispenser of claim 9, wherein a carousel dispenser card return slot structure is mounted on the top of said cover; a card retainer member positioned toward the radially inner end of and beneath said card return slot structure equipped with an upper ledge and a lower ledge; and a switch mounted in association with said retainer means having an actuator subject to being actuatingly depressed when a card inner edge is moved past said upper ledge of the retainer down to the lower ledge of the retainer to thereby switch actuate drive power through said drive switch to said drive motor and start rotative movement of said carousel by successive steps from a drive compartment position rotationally to the next successive drive compartment on station position.

11. The carousel card dispenser of claim 10, wherein an actuator button, with a resilient return spring provided biasing the button to the non-activated position, is positioned to move a radially inner edge of a reinserted card from said upper ledge to said lower ledge of the card retainer when the button is pushed to the activated state.

12. The carousel card dispenser of claim 11, wherein the bottom of the upper ledge holds the inner edge of the card in the switch activated state, even though the actuator button is released from the activated state, until such time as the carousel with the compartment and card being so held is rotated out of alignment with the retainer; and with further rotative movement of the card beyond the switch the card falls completely into its respective card storage compartment.

13. The carousel card dispenser of claim 12, wherein there is power actuation overlap between actuation of the card actuated upper switch and said lower rotational cam actuated switch.

14. The carousel card dispenser of claim 13, wherein said upper switch mechanism is mounted to a side of said retainer on the side thereof in the direction of rotation of said carousel.

15. The carousel card dispenser of claim 14, wherein each of said card storage compartments has a resiliently deflectable depending arm retainer extending down from the top of the card storage compartment to a bottom end spacing from the upper surface of the carousel base sufficient to permit passage thereunder of the bottom card of that respective card storage compartment as the bottom card is being cam driven to the extended dispensing state.

16. The carousel card dispenser of claim 15, wherein said cover is provided with an opening of sufficient arcuate extent in said depending cylindrical skirt portion to permit the outward feeding advancement of a bottom card of a compartment as it is being driven outward by said card extend drive cam.

* * * * *